US006175631B1

(12) United States Patent
Davis et al.

(10) Patent No.: US 6,175,631 B1
(45) Date of Patent: Jan. 16, 2001

(54) METHOD AND APPARATUS FOR DECORRELATING AUDIO SIGNALS

(76) Inventors: Stephen A. Davis, 3594 Gibson Ave., Santa Clara, CA (US) 95051; Martin Walsh, 410 Sheridan Ave. #217, Palo Alto, CA (US) 94306; David Berners, 2470 Betlo Ave., Mountain View, CA (US) 94043

( * ) Notice: Under 35 U.S.C. 154(b), the term of this patent shall be extended for 0 days.

(21) Appl. No.: 09/350,967

(22) Filed: Jul. 9, 1999

(51) Int. Cl.[7] ..... H04R 5/00; H04R 5/02
(52) U.S. Cl. ..... 381/17; 381/18; 381/310
(58) Field of Search ..... 381/17, 18, 11, 381/310

(56) References Cited

U.S. PATENT DOCUMENTS

| | | | | |
|---|---|---|---|---|
| 5,414,774 | * | 5/1995 | Yumoto | 381/1 |
| 5,748,513 | * | 5/1998 | Van Duyne | 364/724.17 |
| 5,761,315 | * | 6/1998 | Iida et al. | 381/18 |
| 5,974,153 | * | 10/1999 | Cashion et al. | 381/11 |
| 6,009,179 | * | 12/1999 | Wood et al. | 381/17 |

OTHER PUBLICATIONS

Schroeder, M.R., et al, "Computer Simulation of Sound Transmission in Rooms", IEEE International Convention Record, (7), Mar. 25–28, 1963, New York, NY.

Wightman, Frederic L. and Kistler, Doris J., "Headphone simulation of free–field listening. II: Psychophysical validation", J. Acoust. Soc. Am. 85 (2), Feb. 1989, p. 868–878.

Steiglitz, Ken, "A Digital Signal Processing Primer", Addison–Wesley, 1996, p. 113–119.

Organidis, Sophocles J., Introduction to Signal Processing:, Prentice–Hall, 1996, pp. 369–371.

Eargle, John M., "Handbook of Recording Engineers", Chapman & Hall, 1996, pp. 134–140.

* cited by examiner

*Primary Examiner*—Forester W. Isen
*Assistant Examiner*—Brian Tyrone Pendleton
(74) *Attorney, Agent, or Firm*—Ritter, Van Pelt and Yi LLP

(57) ABSTRACT

A system and method are described for rendering a left rear surround input signal at a left rear virtual speaker location and rendering a right rear surround input signal at a right rear virtual speaker location. The method includes phase shifting the left rear surround input signal by a first phase shift. The right rear surround input signal is phase shifted by a second phase shift. The phase shifted left rear surround input signal is phase shifted using an HRTF selected to render the left rear surround input signal at the left rear virtual speaker location. The phase shifted right rear surround input signal is transformed using an HRTF selected to render the right rear surround input signal at the right rear virtual speaker location.

8 Claims, 8 Drawing Sheets

METHOD AND APPARATUS FOR DECORRELATING AUDIO SIGNALS

FIELD OF THE INVENTION

The present invention relates generally to audio signals. More specifically, a dynamic decorrelator for surround sound signals is disclosed.

BACKGROUND OF THE INVENTION

Various formats have been developed for providing surround sound to a four or five speaker configuration. For example, two input formats that contain surround channels are 5.1 channel Dolby Digital AC-3® and Dolby Pro Logic®. Although many home theatres include four or five speakers, many televisions are configured with only a pair of front speakers. It may be desired to play surround signals through a stereo system that has only two front speakers and still achieve the surround sound effect to the listener produced by the rear speaker surround channels.

The above mentioned surround sound formats and other surround sound formats include rear speaker surround input signals that are intended to be played through a set of rear speakers. The rear speakers may be imaged by a pair of front speakers by transforming the rear speaker surround input signals to signals that have the same effect on a listener when the transformed signals are played through a pair of front speakers. A surround sound effect is created for a listener by transforming signals using the head related transfer function (HRTF) of the listener (or an approximate or average HRTF) to transform the rear speaker surround input signals. The transformed signals are output from a set of front speakers so that rear speakers are virtually rendered at a location behind the listener.

A series of IIR filters may be used to implement the HRTF and a crosstalk canceler is used to cancel the crosstalk between the left and right front speakers. Crosstalk cancellation is described in Schroeder, M. R., and Atal, B. S. (1963): "Computer Simulation of Sound Transmission in Rooms", IEEE International Convention Record (7), IEEE Press, New York, and HRTF's are described in Wightman, F. L. and Kistler, D. J. (1989): "Headphone Simulation of Free-Field Listening. II: Psychophysical validation.", J. Acoust. Soc. Am., vol. 85, pp. 868–878 which are both herein incorporated by reference for all purposes. FIG. 1 is a block diagram illustrating a system for using an HRTF to virtually render sounds at different locations around a listener.

Thus, when an appropriate HRTF is used, the rear speaker signals from a surround sound format may be made to appear to a listener to emanate from a set of virtual rear speakers. However, a problem occurs when the left and right rear speaker channels contain the same content, that is, when the left and right rear speaker channels are mono and not stereo. This is always the case for Pro Logic signals, which include one signal that is played in both of the rear channels. It is also the case with many movie soundtracks or at least portions of those soundtracks that are encoded with 5.1 channel Dolby Digital AC-3. Even though Dolby AC-3 provides for separate left and right rear surround speaker channels, it is often the case that the two channels contain completely mono or partially mono content. Only occasional sound effect sequences appear in stereo while the surround music track is often mono or very close to mono.

Unfortunately, in systems that include only front speakers, the surround mono signals do not virtualize behind the listener and instead tend to collapse to the center of the two front speakers. The surround sounds thus appear to emanate from a point directly in front of the listener between the two front speakers. In order to solve this problem, it would be desirable to convert the mono rear signal to a stereo rear signal. This mono to stereo conversion is also referred to as decorrelation. Ideally, the decorrelation should not alter the listener's perception of the two decorrelated signals any more than is necessary to create the perception of separation between the signals.

Different methods have been developed to convert mono signals to stereo in order to provide separation between the sound output from a pair of speakers. One method is to shift the pitch in each of the signals slightly in opposite directions so that the average pitch remains the same but the two signals are sufficiently different from each other to create the perception of separation to the listener. This method tends to be computationally intensive, however, and is not desirable for that reason. In addition, when one speaker output is heard more than the other, the pitch shifting may be perceived by the listener, creating an undesirable effect.

Another method is to pass the input signal to the two speakers through a pair of complementary comb filters. The outputs from the complementary comb filters combine to reproduce the original signal. However, this method relies on the two signals combining in the air to achieve the desired effect. The comb filtering of each signal results in objectionable coloration when one of the individually filtered signals is heard separately. The effect does not work at all over headphones because the signals do not combine. Thus, the method is not desirable for converting identical rear surround signals to stereo since, when the listener hears one of the uncombined signals, the listener perceives significant coloration. Both signals must combine and reach the ears of the listener to achieve a desirable result. 3D sound processing individually comb-filtered signals and expecting them to later combine in the air with a reasonable result is not feasible. The signals should be properly decorrelated before 3D sound processing. That cannot be accomplished using the complementary comb filter technique and so the technique is unsuitable.

A better method of decorrelating two identical signals is needed. Ideally, each rear surround signal should sound acceptable without being combined with the other rear surround signal. Also, it would be desirable if the decorrelation could be performed in a non-computationally intense manner. Finally, it would be desirable if the decorrelation could be adjusted to only occur when the rear surround input signals are truly mono. In addition, such an improved method of decorrelation would be useful for real speakers to provide a sense of spaciousness around the listener instead of a middle of the head sensation.

SUMMARY OF THE INVENTION

A dynamic decorrelator for surround sound signals is disclosed. In one embodiment, a mono detection circuit is used to detect the extent to which a left rear surround input signal and a right rear surround input signal are similar. To the extent that the surround input signals are similar, the signals are decorrelated. Decorrelation is performed by a pair of allpass filters that introduce complementary phase shifts in the left rear surround input signal and the right rear surround input signal. The complementary phase shifts are sufficient to prevent the surround signals from collapsing to the front of the listener when they are rendered using a pair of front speakers.

It should be appreciated that the present invention can be implemented in numerous ways, including as a process, an apparatus, a system, a device, a method, or a computer readable medium such as a computer readable storage medium or a computer network wherein program instructions are sent over optical or electronic communication lines. Several inventive embodiments of the present invention are described below.

In one embodiment, a method of rendering a left rear surround input signal at a left rear virtual speaker location and rendering a right rear surround input signal at a right rear virtual speaker location is described. The method includes phase shifting the left rear surround input signal by a first phase shift. The right rear surround input signal is phase shifted by a second phase shift. The phase shifted left rear surround input signal is phase shifted using an HRTF selected to render the left rear surround input signal at the left rear virtual speaker location. The phase shifted right rear surround input signal is transformed using an HRTF selected to render the right rear surround input signal at the right rear virtual speaker location.

In another embodiment, a method of decorrelating a first input signal and a second input signal is described. The method includes phase shifting the first input signal by a first phase shift and phase shifting second input signal by a second phase shift. The first input signal and the second input signal are decorrelated in a manner that does not distort either the first input signal or the second input signal in the perception of a listener when one of the input signals is heard without being combined with the other input signal.

In another embodiment, a method of converting a mono input signal to a pair of stereo input signals is described. The method includes filtering the mono input signal using a band pass filter. The band pass filter substantially passes frequencies in a vocal range of frequencies and substantially blocks frequencies outside of the vocal range of frequencies to produce a band pass filter output signal. The mono input signal is filtered using a high pass filter. The high pass filter substantially passes frequencies above a vocal range of frequencies and substantially blocks frequencies within the vocal range of frequencies and frequencies below the vocal range of frequencies to produce a high pass filter output signal. The mono input signal is filtered using a low pass filter. The low pass filter substantially passes frequencies below a vocal range of frequencies and substantially blocks frequencies within the vocal range of frequencies and frequencies above the vocal range of frequencies to produce a low pass filter output signal. The low pass filter output signal and the high pass filter output signal are combined, split, and decorrelated to produce at least a pair of decorrelated signals and each of the decorrelated signals are combined with the band pass filter output signal to produce a stereo output signal that includes decorrelated signals above and below the vocal range of frequencies.

In another embodiment, a dynamic decorrelator for decorrelating a first input signal and a second input signal is described. The dynamic decorrelator includes a first allpass filter configured to phase shift the first input signal by a first phase shift and a second allpass filter configured to phase shift the second input signal by a second phase shift. A mono detection circuit is configured to detect the similarity of the first input signal and the second input signal and to adjust the first phase shift and the second phase shift according to the similarity of the first input signal and the second input signal.

These and other features and advantages of the present invention will be presented in more detail in the following detailed description and the accompanying figures which illustrate by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION

A detailed description of a preferred embodiment of the invention is provided below. While the invention is described in conjunction with that preferred embodiment, it should be understood that the invention is not limited to any one embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention. The present invention may be practiced according to the claims without some or all of these specific details. For the purpose of clarity, details relating to technical material that is known in the technical fields related to the invention has not been described in detail in order not to unnecessarily obscure the present invention in such detail.

Figure 1:
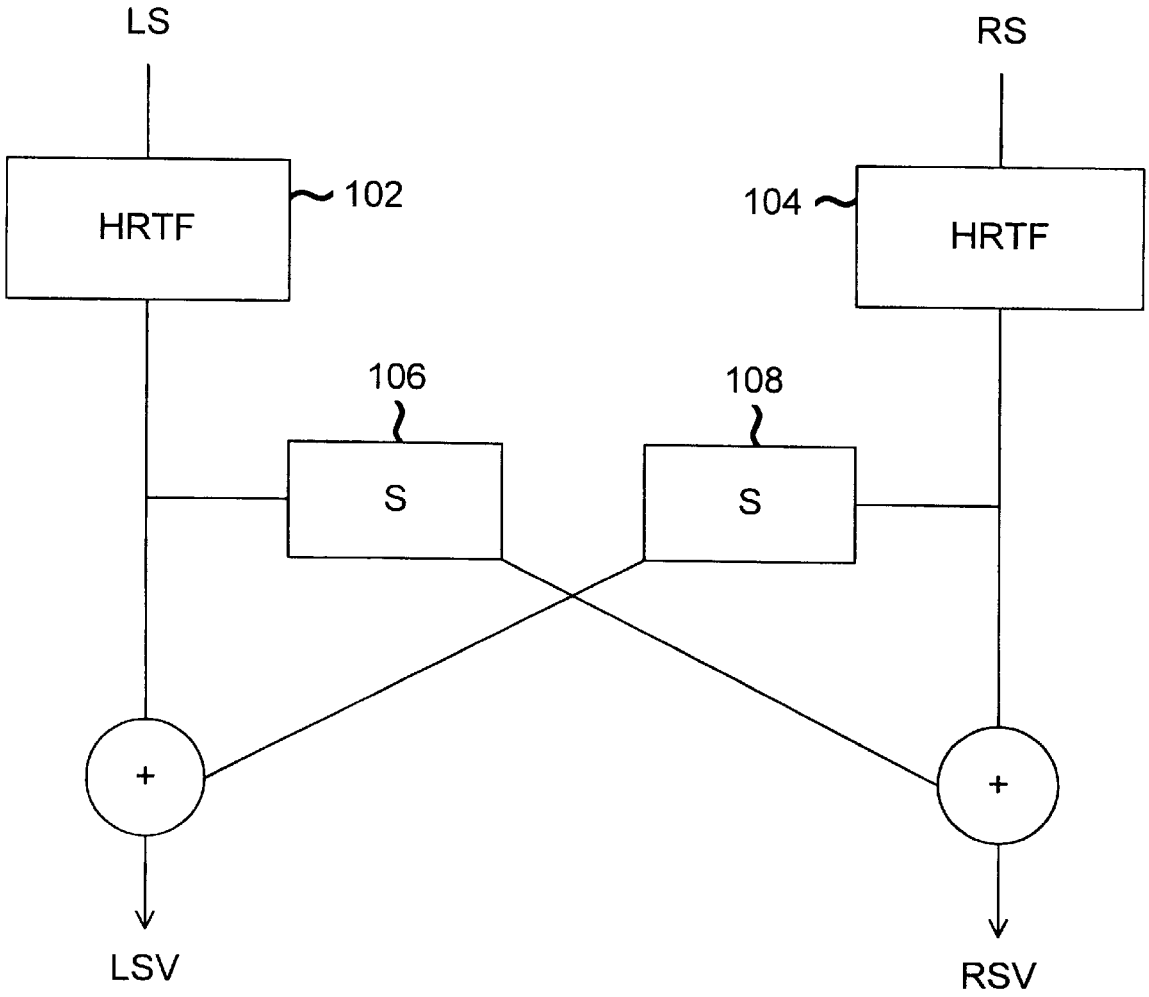
FIG. 1 is a block diagram illustrating a 3D sound virtualization system that performs HRTF modeling and cross talk cancellation for the purpose of virtually rendering a pair of speakers at a position relative to a listener where no real speakers are located.

FIG. 1 is a block diagram illustrating a 3D sound virtualization system that performs HRTF modeling and cross talk cancellation for the purpose of virtually rendering a pair of speakers at a position relative to a listener where no real speakers are located. A left surround signal and a right surround signal are input to HRTF filters 102 and 104, respectively. In one embodiment, the HRTF filters are implemented using a network of infinite impulse response (IIR) filters. Other methods of rendering HRTF's may be used as well. The outputs of the HRTF filters are split and fed through a cross talk cancellation network that includes a pair of cross talk cancellation filters 106 and 108. The output of filters 106 and 108 is summed with the HRTF outputs to provide a left surround virtual (LSV) and right surround virtual (RSV) input signal. Depending on the HRTF implemented, the input LS and RS signals may be rendered at a virtual location relative to the listener.

As described above, when LS and RS are the same, the surround effect is lost and the signals appear to the listener as a mono signal from the front speakers. This is especially a problem when the left ear and right ear HRTF's for each of the respective surround signals are the same, which is often the case. In one embodiment, the LS and RS signals are phase shifted in a complementary manner to make the two signals different. The complementary phase shifts do not create undesirable effects, but they are effective to separate the two signals.

Figure 2A:
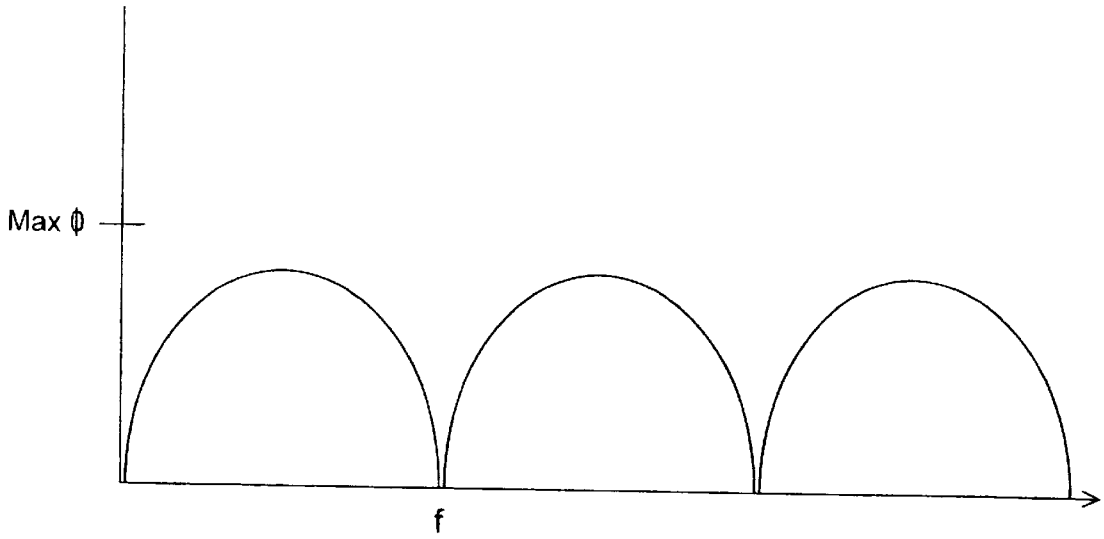
FIG. 2A is a graph illustrating an exemplary phase excursion implemented using an all pass filter.
Figure 2B:
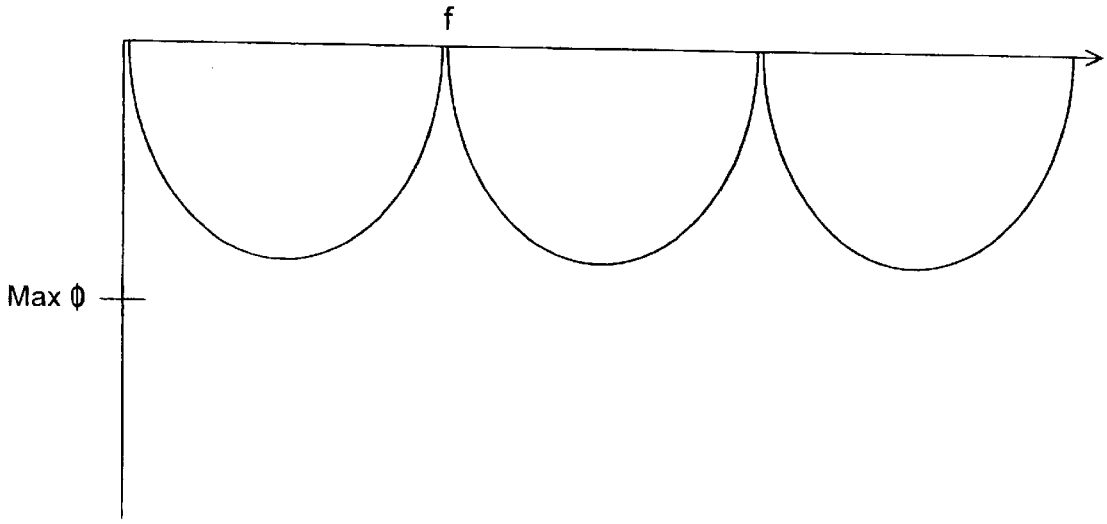
FIG. 2B is a graph illustrating the phase excursion implemented by the decorrelator in the other surround input.

FIG. 2A is a graph illustrating an exemplary phase excursion implemented using an all pass filter. The phase difference that is applied to one of the surround signals varies as a function of frequency between a minimum phase excursion of zero and a maximum excursion labeled max $\phi$. FIG. 2B is a graph illustrating the phase excursion implemented by the decorrelator in the other surround input. The phase excursion shown in FIG. 2B is complementary to the phase excursion of FIG. 2A. Thus, a maximum phase difference between the two channels is realized with a minimum amount of phase shifting of each of the individual channels from their original phase.

In other embodiments, other phase excursions for the signal may be implemented. The phase excursions shown in FIGS. 2A and 2B are particularly useful because they may be implemented using an all pass filter. Because complementary phase excursions are used, a maximum difference between the signals is realized. In other embodiments, phase excursions that are not complementary may be used. Most significantly, it has been found that changing the phase of each of the signals does successfully create separation between the signals and prevent the surround signals from collapsing to a mono signal that is perceived to emanate from between the two front speakers. While modifying the phase of each of the signals creates this separation, it does not alter the sound of each of the input signals in a deleterious manner. Unlike the case where complementary comb filters are used to create separation between the two surround input signals, the two complementary phase shifted signals need not combine in the air for the proper effect to be perceived by the listener.

Figure 3A:
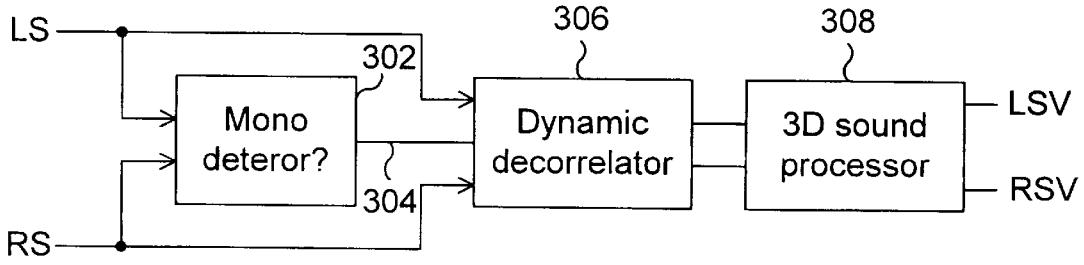
FIG. 3A is a block diagram illustrating a system used to dynamically decorrelate surround sound signals.

FIG. 3A is a block diagram illustrating a system used to dynamically decorrelate surround sound signals. A left surround signal, LS, and a right surround signal RS are input to the system. The signals are split and fed into a monodetector 302. Monodetector 302 detects the extent to which the two input signals are the same. Monodetector 304 is described further in FIG. 4. Monodetector 302 outputs a control signal 304 that indicates the extent to which the LS and the RS signals are the same.

Control signal 304 is input into a dynamic decorrelator 306. Dynamic decorrelator 306 also receives the LS and the RS signal as inputs. The dynamic decorrelator changes the phase of the RS and the LS signals in a manner described in FIG. 2. The maximum phase excursion in each of the channels is determined by the control signal input from the monodetector. For example, if the monodetector detects that the signals are exactly the same, then the control signal will indicate to the dynamic decorrelator that the maximum possible phase shift is to be used. As the two input signals become less and less similar, the control signal output from the monodetector decreases and the dynamic decorrelator in response to that signal decreases the maximum phase excursion applied to each of the channels.

The dynamic decorrelator outputs two signals corresponding to LS and RS with each signal being phase shifted in a complementary manner. The outputs, in one embodiment, are fed into a 3D sound processor 308. 3D sound processor 308 modifies the input signals so that they will be imaged behind the listener. 3D sound processor 308 outputs a left surround virtual signal and a right surround virtual signal labeled LSV and RSV. The LSV and the RSV are signals that image the RS and the LS signals behind the listener when they are input to speakers which are in front of the listener. In one embodiment, 3D sound processor 308 uses a HRTF filters and cross talk cancellation such as is shown in FIG. 1. Other 3 dimensional sound rendering schemes are used in other embodiments. It should also be noted that the output of dynamic decorrelator 306 and/or 3D sound processor 308 may be limited by a limiter to prevent the strength of the signal from exceeding a maximum allowable signal amplitude so that distortion or damage of other components in the audio system is prevented.

Thus, the RS and LS signals are modified by shifting the phase of the two signals in a complementary manner. The amount that the phase is shifted is controlled by a monodetector that determines the extent to which the two signals are the same and provides a control signal that adjusts the amount of the phase shift. The phase shifted signals are input to a 3D sound processor and, as a result of the separation in the signals introduced by the phase shift, the 3D sound processor is able to effectively render the sounds in a manner that makes them appear to emanate from virtual speaker locations behind a listener.

Figure 3B:
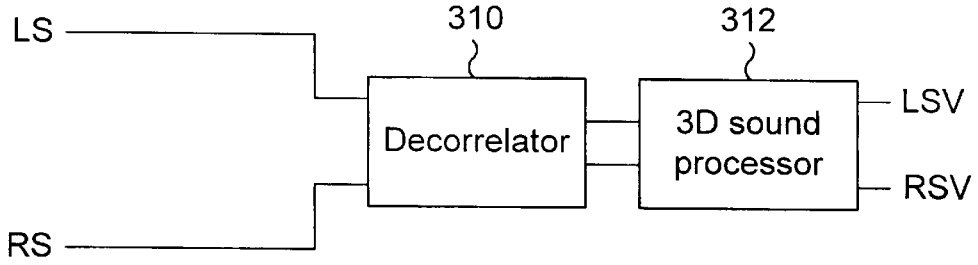
FIG. 3B is a block diagram illustrating a system for producing a left surround virtual and a right surround virtual speaker input signal given left and right surround signals that are the same.

FIG. 3B is a block diagram illustrating a system for producing a left surround virtual and a right surround virtual speaker input signal given left and right surround signals that are the same. Such identical surround signals are produced, for example, by a Prologic system. The system of FIG. 3B may also be used for other systems that include left and right surround signals that are essentially mono. The left surround and right surround signals are input to a decorrelator 310.

Decorrelator 310 is similar to the dynamic decorrelator 306 shown in FIG. 3A except that decorrelator 310 does not respond to a control signal that indicates the extent to which the LS and RS signals are the same. Decorrelator 310 introduces a complementary phase shift in the RS and LS signals that provide separation between the signals. The output of decorrelator 310 is input to a 3D sound processor 312. 3D sound processor 312 transforms the input signal into a left surround virtual and a right surround virtual signal that creates the impression for a listener that the LS and RS signals are emanating from a pair of rear speakers. 3D sound processor 312 may use an HRTF filter/cross talk canceller system such as is described in FIG. 1.

Figure 3C:
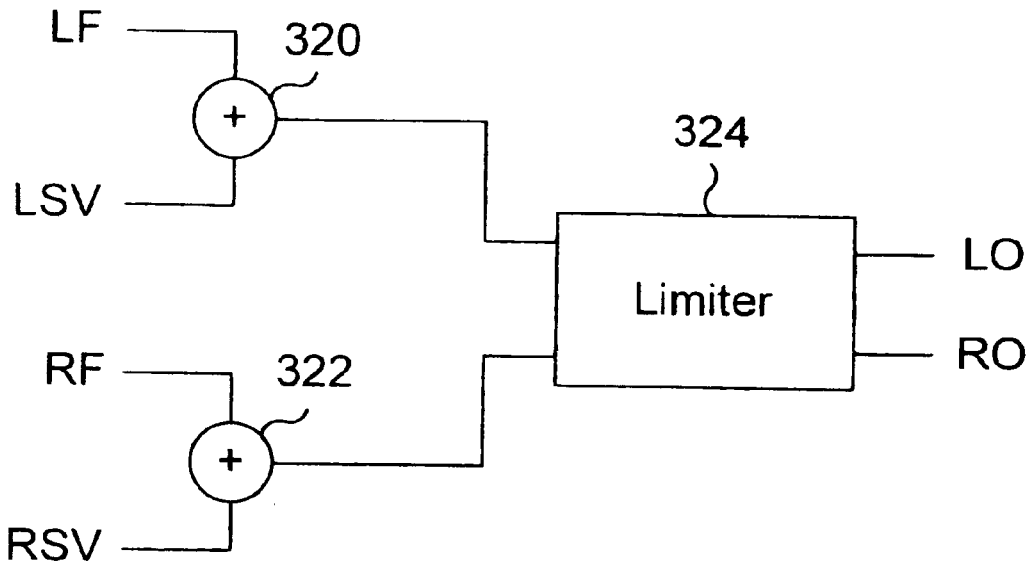
FIG. 3C is a block diagram illustrating a system for combined left and right front signals, designated RF and LF with left and right surround virtual signals, RSV and LSV, to produce a combined left output, LO, and right output, RO, signal.

FIG. 3C is a block diagram illustrating a system for combined left and right front signals, designated RF and LF with left and right surround virtual signals, RSV and LSV, to produce a combined left output, LO, and right output, RO, signal. The left front signal and the left surround virtual signal are combined by a combiner 320 and the right front and right surround virtual signals are combined by a combiner 322. The outputs of the combiners are passed through a limiter 324 that limits the combined signal power to prevent distortion or damage to the rest of the audio system. Limiter 324 outputs a combined left output and right output signal. The left output and right output signals contain both the front speaker signals and the virtualized rear speaker signals. When the outputs are applied to the front speakers, the desired surround effect is achieved.

Figure 4:
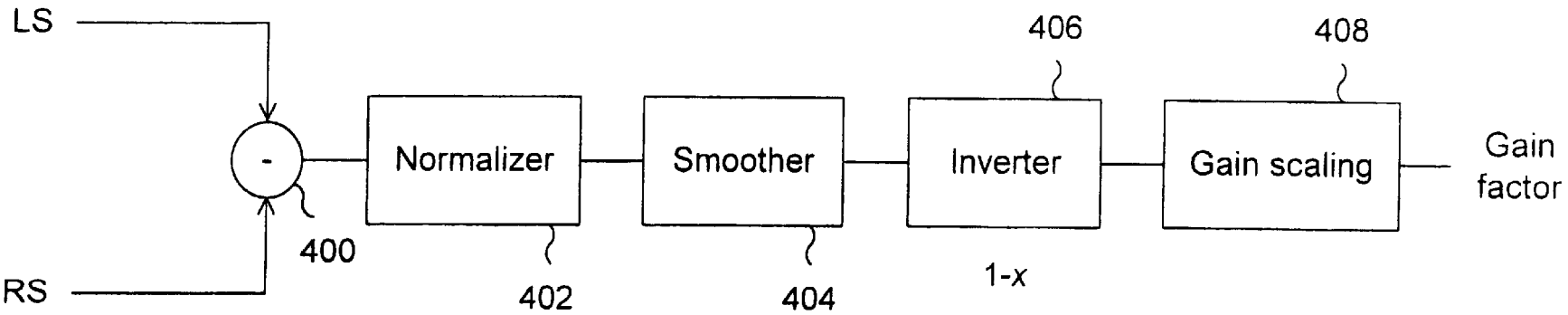
FIG. 4 is a block diagram illustrating a design of a monodetector implemented in block 302 of FIG. 3A in one embodiment.

FIG. 4 is a block diagram illustrating a design of a monodetector implemented in block 302 of FIG. 3A in one embodiment. A left surround signal, LS, and a right surround signal, RS, are input to a subtracting node 400. Subtracting node 400 determines the difference between LS and RS. If LS and RS are identical, then the output of subtracting node 400 is zero or nearly zero and the output of subtracting node 400 increases as the difference between LS and RS increases. The output of subtracting node 400 is input to a normalizer 402. Normalizer 402 takes the absolute value of the output of subtracting node 400 and normalizes it so that it is between zero and a maximum predetermined value. For purposes of this example, the maximum predetermined value is one. It should be noted that the subtracting node may already provide an output that is the absolute value of the difference or subtracting node 400 may output a signal that is either positive or negative.

The output of normalizer 402 is input to a smoother 404. Smoother 404 smoothes the difference signal so that the change in the control signal that is produced by the monodetector is decreased. It has been found that if the phase change introduced by the dynamic decorrelator to provide separation in the surround signals is changed rapidly that undesirable sound impressions are created. Smoother 404 decreases the rate of change so that large phase shifts are not quickly introduced or removed from the signal.

In one embodiment, smoother 404 includes an envelope detector, and a low pass filter. The envelope detector follows the peak value of the input signals to maximize the decorrelation for a signal that has significant mono content. Without the envelope detector, the final output gain factor would never reach its maximum value. The envelope detector also provides some smoothing so that the difference signal output does not change rapidly.

The smoothing provided by the envelope detector is not enough to give a sufficiently smooth time varying decorrelation control signal for many applications. Therefore the output of the envelope detector is input to a tracking filter to smooth the response further and provide greater control over its variance over time. In one embodiment, the tracking filter time constant may be adjusted to provide the desired audio quality and separation. The tracking filter is a low pass filter that removes high frequency components from the output of the envelope detector.

It has been found that the combination of the envelope detector and tracking filter provides a smoothly varying decorrelation control signal. The control signal provides enough decorrelation because the envelope detector follows the maximum of the difference signal and also provides sufficiently smooth time varying decorrelation as a result of the combination of the envelope detector and the low pass filter. Just using the envelope detector may result in audible artifacts for quickly varying input signals. Using the tracking filter alone without the envelope detector tends to average the input too much to give a sufficiently strong separation effect. The combination of the envelope detector and the tracking filter provides a particularly desirable effect. It should be noted that in FIG. 4, the smoother that includes the envelope detector is shown operating on an already normalized signal. In other embodiments, the envelope detector may be applied to the raw output of the subtracting node. However, applying the envelope detector to the normalized signal simplifies the design of the envelope detector.

The output of smoother 404 is input to a signal inverter 406. The purpose of signal inverter 406 is simply to invert the signal so that a greater amount of change in the inputs provides a smaller level control signal. If normalizer 402 normalizes the signal to a strength of one, then inverter 406 may simply apply a 1−x transformation to the signal. The output of inverter 406 is input to a gain scaling processor 408. Gain scaling processor 408 maps the normalized, smoothed, and inverted difference signal to a gain factor that can be applied to the all pass filters that control the complementary phase shifts introduced in the input surround signals for the purpose of providing separation. Thus, the gain factor output by the monodetector circuit is a decorrelation control signal that controls the amount of decorrelation of the surround input signals based on the amount of difference between the two signals.

Greater decorrelation is performed when the signals are nearly the same and less decorrelation is performed when the signals are already different. Thus, any artificial sound effects created by the introduction of the phase change by the decorrelator are minimized when the signals are already different and the effect of the decorrelator is maximized when the input signals are nearly the same. The smoothing provided by the monodetector prevents rapid changing between a large amount of decorrelation and a small amount of decorrelation, which might itself produce undesirable sound effects.

Thus far, a dynamic decorrelation system for introducing complementary phase shifts into left and right surround input signals to provide separation between those signals has been described. Next, the all pass filters used in one embodiment to provide the complementary phase shifts will be described.

Figure 5A:
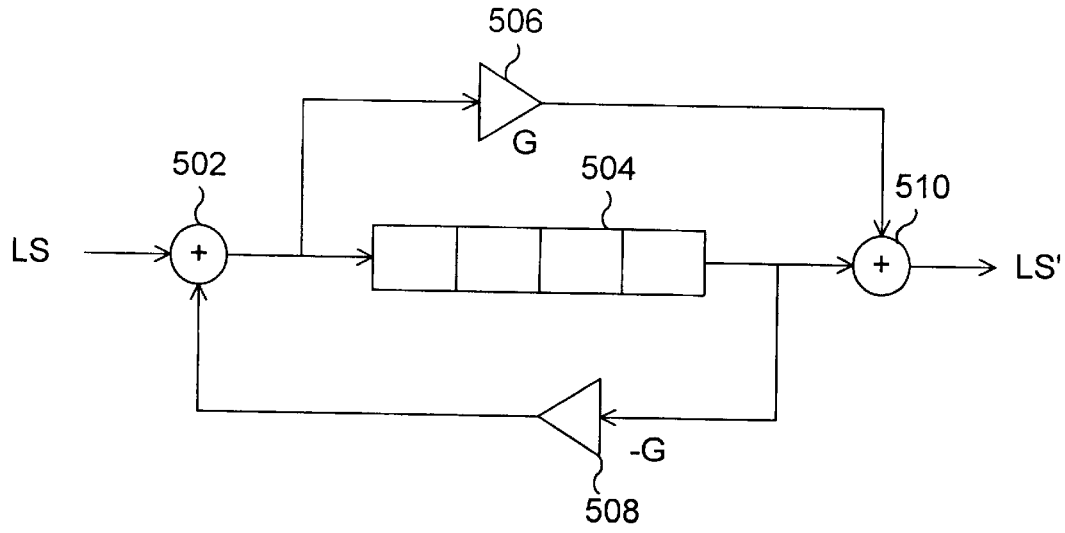
FIGS. 5A and 5B are block diagrams illustrating a pair of all pass filters that provide complementary phase shifts to a left surround signal LS and a right surround signal RS.
Figure 5B:
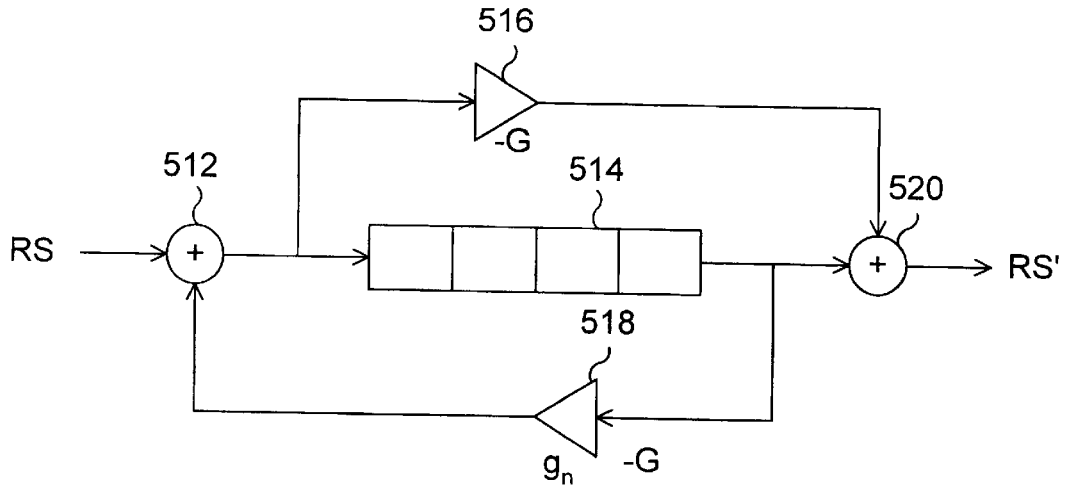

FIGS. 5A and 5B are block diagrams illustrating a pair of all pass filters that provide complementary phase shifts to a left surround signal LS and a right surround signal RS. Left surround signal LS is input to a summing junction 502. The output of summing junction 502 is split between a delay line 504 and amplifier 506. Amplifier 506 has a gain G. The output of delay line 504 is split with a portion fed back to summing junction 502 through an amplifier 508 that has a gain of −G. The other portion of the output of delay line 504 is input to a summing junction along with the output of amplifier 506. The output of the summing junction is signal LS'. Signal LS' is a modified version of signal LS with the phase changed in the manner shown in FIG. 2A or FIG. 2B. The maximum amount of phase difference between LS' and LS is determined by the absolute value of the gain in amplifiers 506 and 508.

In general, a large positive and negative gain in the two amplifiers of the all pass filter causes a larger phase excursion. However, a large gain may cause ringing in the output signal and so a smaller gain may be desired. In one embodiment, a large phase excursion is produced without causing ringing by chaining a number of all pass filters each having a smaller gain to create a large combined phase excursion from the chained filters while preventing ringing. In addition, a number of identical all pass stages may be chained to allow the length of the delay line to be smaller in each of the individual all pass filters. By chaining all pass filters and using smaller gains and smaller delays, ringing may be reduced and the spread of the group delay may be improved. In addition, a smaller gain corresponds to a wider peak or notch in the group delay. A larger gain corresponds to a more narrow peak or notch in the group delay. In general, a wider spread produces a better effect since more frequencies are affected. In one embodiment, a delay of 10 ms is introduced for each channel and a maximum gain of 0.4 for AC-3 and 0.5 for Pro Logic is used.

Right surround signal RS is input to a summing junction 512. The output of summing junction 512 is split between a delay line 514 and amplifier 516. Amplifier 516 has a gain −G. The output of delay line 514 is split with a portion fed back to summing junction 512 through an amplifier 518 that has a gain of G. The other portion of the output of delay line 514 is input to a summing junction along with the output of amplifier 516. The output of the summing junction is signal RS'. Signal RS' is a modified version of signal RS with the phase changed in the manner shown in FIG. 2A or FIG. 2B. The maximum amount of phase difference between RS' and RS is determined by the absolute value of the gain in amplifiers 516 and 518.

In the case of the dynamic decorrelator, the gains of the amplifiers and the all pass filters for the two channels are controlled by the monodetector circuit that derives a control signal based on the extent to which the two input signals are the same. If a chain of all pass filters are used, then the control signal from the monodetector is used to control the gains of each amplifier in the chained filters.

In addition to providing decorrelation of mono signals and dynamic decorrelation of signals that vary between being mono and stereo, a decorrelation method has been developed for decorrelating mono signals which contain dialogue without decorrelating the dialogue portion of the signal. Decorrelating the dialogue portion of the signal may have the undesirable effect of separating different parts of a single voice between a pair of stereo speakers and creating the unsettling impression that the voice is coming from more than one direction. This makes decorrelating mono signals that include dialogue difficult. It would, however, be useful to provide a widening of sound for old mono recordings of movies which, of course, generally contain a significant amount of dialogue. Decorrelation would be useful both for widening the sound from the front speakers and also for providing rear speaker surround sound signals.

Figure 6:
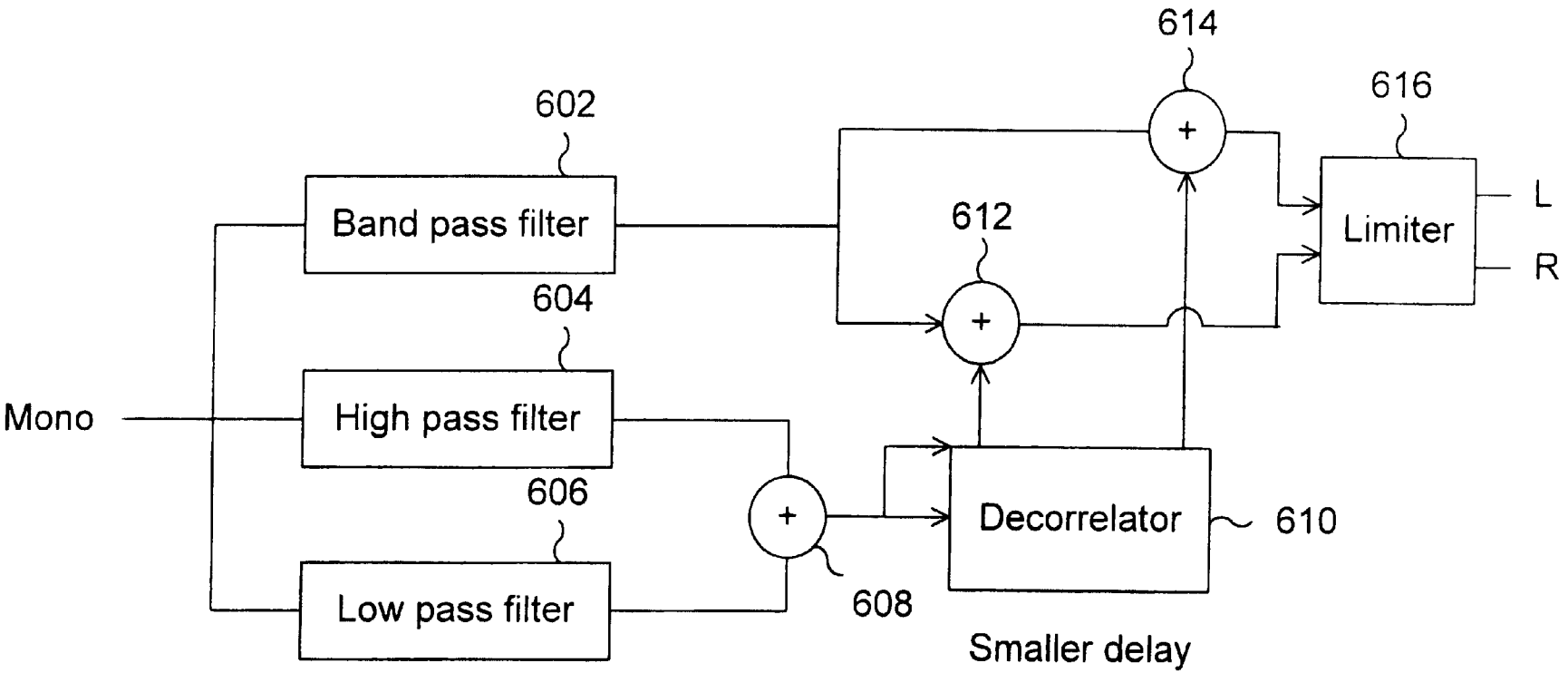
FIG. 6 is a block diagram of a system for providing decorrelation of portions of a mono signal while not decorrelating dialogue.

FIG. 6 is a block diagram of a system for providing decorrelation of portions of a mono signal while not decorrelating dialogue. It has been found that most of the dialogue in a signal is found between 300 Hz and 3 kHz. A mono signal is input to the system and split three ways between a band pass filter 602, a high pass filter 604, and a low pass filter 606. Band pass filter 602 passes frequencies that are between about 300 Hz and 3 kHz. The output of the band pass filter is split and recombined with the other parts of the input signal to create a left and right channel.

The output of high pass filter 604 and the output of low pass filter 606 are recombined at a summing junction 608. The output of summing junction 608 is split and input to a decorrelator 610 that introduces a complementary phase shift into the two input signals as is described above. The output of the decorrelator is combined with the split output of band pass filter 602 at summing junctions 612 and 614. The outputs of summing junctions 612 and 614 are input to a limiter 616 which limits the power of the output left and right channels. It should be noted that decorrelator 610 is implemented with a small delay so that the timing between the audio portion of the signal spectrum from between 300 Hz and 3 kHz and the other portion of the signal that was processed by high pass filter 604 and low pass filter 606 is not altered.

Thus, a mono signal is split and the portion of the mono signal that includes dialogue is not decorrelated. The portions of the signal spectrum above and below the dialogue band are decorrelated and recombined with the dialogue portion of the signal. The effect created is that the dialogue remains mono and is perceived to emanate from directly between the two front speakers while the remainder of the signal that includes sound effects and possible music is decorrelated and widened.

Figure 7:
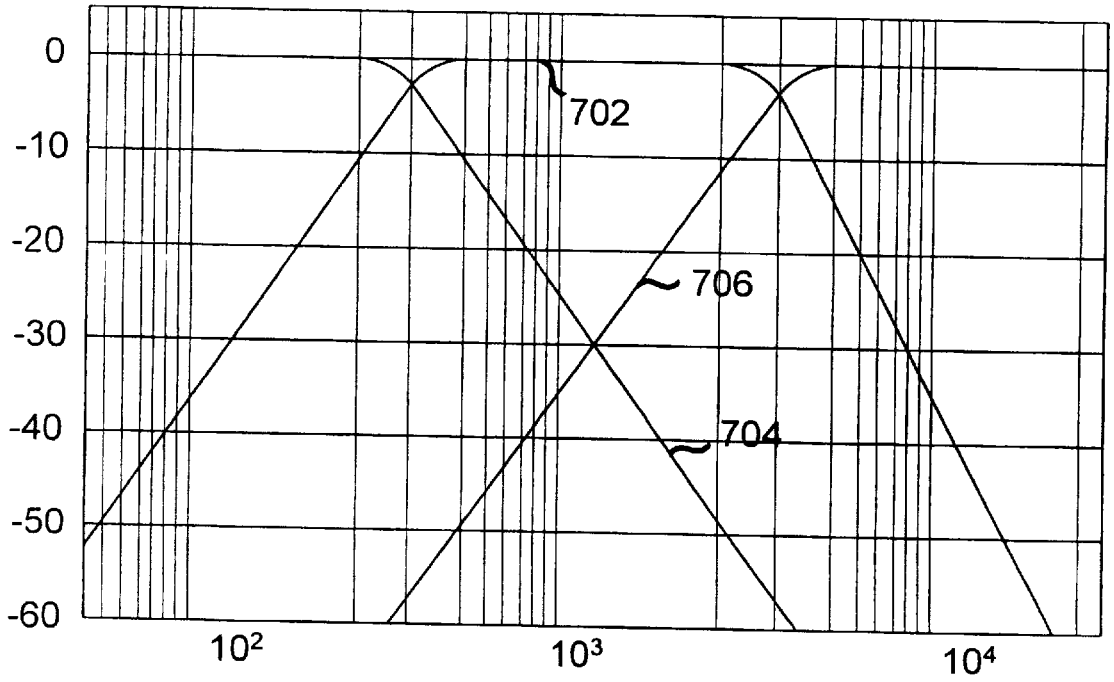
FIG. 7 illustrates the frequency response three filters used in one embodiment.

The three filters serve to separate the low frequencies, the vocal range frequencies and the high frequencies. In one embodiment the filters are designed to be complementary filters so that their combined output is intended to match the original input signal within some tolerance. In one embodiment, the tolerance is about + or −−0.1 dB. In one embodiment, the low pass and high pass filters are third order Butterworth filters and the band pass filter is a sixth order Butterworth filter. The frequency response of the three filters is shown in FIG. 7. The band pass filter output is shown by plot 702. The output of the low pass filter is shown by plot 704, and the output of the high pass filter is shown by plot 706. It should be appreciated that other band pass filters, low pass filters and high pass filters can be used to also achieve the desired effect of separating dialogue from the input signal before decorrelation of the signal.

An improved method for decorrelating audio signals has been disclosed. The method is particularly useful for rendering virtual speakers that output surround sound signals using only a two speaker configuration since many surround sound formats provide mirror surround signals that are mono or close to mono. Virtual surround speakers may be rendered for any multichannel format with left surround and right surround channels, including Pro Logic, AC-3, DTS and SDDS. The method is also useful for providing separation for real speakers. A dynamic decorrelator has been disclosed that adjusts the amount of decorrelation provided based on an analysis of the amount of difference of two input signals. Finally, a decorrelation system has been disclosed that decorrelates portions of an input mono signal without decorrelating the dialogue portion of such a signal.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims.

What is claimed is:

1. A method of converting a mono input signal to a pair of stereo input signals comprising:

filtering the mono input signal using a band pass filter, the band pass filter substantially passing frequencies in a vocal range of frequencies and substantially blocking frequencies outside of the vocal range of frequencies to produce a band pass filter output signal;

filtering the mono input signal using a high pass filter, the high pass filter substantially passing frequencies above a vocal range of frequencies and substantially blocking frequencies within the vocal range of frequencies and frequencies below the vocal range of frequencies to produce a high pass filter output signal;

filtering the mono input signal using a low pass filter, the low pass filter substantially passing frequencies below a vocal range of frequencies and substantially blocking frequencies within the vocal range of frequencies and frequencies above the vocal range of frequencies to produce a low pass filter output signal;

decorrelating the low pass filter output signal and the high pass filter output signal to produce at least a pair of decorrelated signals; and combining each of the decorrelated signals with the band pass filter output signal to produce a stereo output signal that includes decorrelated signals above and below the vocal range of frequencies.

2. A method of converting a mono input signal to a pair of stereo input signals as recited in claim 1 wherein the low pass filter output signal and the high pass filter output signal are combined before the low pass filter output signal and the high pass filter output signal are decorrelated.

3. A method of converting a mono input signal to a pair of stereo input signals as recited in claim 1 wherein the vocal range of frequencies extends from approximately 300 Hz to approximately 3 kHz.

4. A method of rendering a left rear surround input signal at a left rear virtual speaker location and rendering a right rear surround input signal at a right rear virtual speaker location comprising:

phase shifting the left rear surround input signal by a first phase shift;

phase shifting the right rear surround input signal by a second phase shift;

transforming the phase shifted left rear surround input signal using an HRTF selected to render the left rear surround input signal at the left rear virtual speaker location;

transforming the phase shifted right rear surround input signal using an HRTF selected to render the right rear surround input signal at the right rear virtual speaker location; and determining the extent that the left rear surround input signal and the right rear surround input signal are the same and adjusting the magnitude of the first phase shift and the second phase shift according to the extent that the left rear surround input signal and the right rear surround input signal are the same;

wherein phase shifting the left rear surround input signal by a first phase shift is accomplished by passing the left rear surround input signal through a first allpass filter implemented using a first delay line and a first feedback loop having a first gain and wherein phase shifting the right rear surround input signal is accomplished by passing the right rear surround input signal through a second allpass filter implemented using a second delay line and a second feedback loop having a second gain;

adjusting the magnitude of the first phase shift is accomplished by adjusting the first gain; and adjusting the magnitude of the second phase shift is accomplished by adjusting the second gain.

5. A method of decorrelating a first input signal and a second input signal comprising:

phase shifting the first input signal by a first phase shift;

phase shifting second input signal by a second phase shift;

determining the extent that the first input signal and the second input signal are the same; and setting the magnitude of the first phase shift and the magnitude of the second phase shift according to the extent that the first input signal and the second input signal are the same;

wherein phase shifting the first input signal by a first phase shift is accomplished by passing the first input signal through a first allpass filter implemented using a first delay line and a first feedback loop having a first gain and wherein phase shifting the second input signal is accomplished by passing the second input signal through a second allpass filter implemented using a second delay line and a second feedback loop having a second gain;

adjusting the magnitude of the first phase shift is accomplished by adjusting the first gain; and adjusting the magnitude of the second phase shift is accomplished by adjusting the second gain;

whereby the first input signal and the second input signal are decorrelated in a manner that does not distort either the first input signal or the second input signal in the perception of a listener when one of the input signals is heard without being combined with the other input signal.

6. A dynamic decorrelator for decorrelating a first input signal and a second input signal comprising:

a first allpass filter configured to phase shift the first input signal by a first phase shift;

a second allpass filter configured to phase shift the second input signal by a second phase shift; and a mono detection circuit configured to detect the similarity of the first input signal and the second input signal and to adjust the first phase shift and the second phase shift according to the similarity of the first input signal and the second input signal;

wherein the first phase shift and the second phase shift are increased as the similarity of the left rear surround input signal and the right rear surround input signal increases.

7. A dynamic decorrelator for decorrelating a first input signal and a second input signal as recited in claim 6 wherein the second phase shift is complementary to the first phase shift.

8. A dynamic decorrelator for decorrelating a first input signal and a second input signal as recited in claim 6 wherein the first input signal is a left rear surround signal and wherein the second input signal is a right rear surround signal.

* * * * *